US006883564B2

(12) United States Patent
Risch et al.

(10) Patent No.: US 6,883,564 B2
(45) Date of Patent: Apr. 26, 2005

(54) PRESSURIZING SYSTEM FOR A DISPENSING CONTAINER

(75) Inventors: Thomas M. Risch, 41 Rogues Ridge, Weston, CT (US) 06883; Bryan Bourgeois, Underhill, VT (US)

(73) Assignee: Thomas M. Risch, Weston, CT (US)

( * ) Notice: Subject to any disclaimer, the term of this patent is extended or adjusted under 35 U.S.C. 154(b) by 0 days.

(21) Appl. No.: 10/624,996

(22) Filed: Jul. 22, 2003

(65) Prior Publication Data

US 2005/0016622 A1 Jan. 27, 2005

(51) Int. Cl.[7] ..... B65B 1/04

(52) U.S. Cl. ..... 141/113; 141/20; 141/25; 141/356; 141/391

(58) Field of Search ..... 141/18, 20, 25, 141/27, 29, 113, 192, 197, 351–356, 368, 391; 220/203.13; 137/473, 512

(56) References Cited

U.S. PATENT DOCUMENTS

| | | | | | |
|---|---|---|---|---|---|
| 3,337,091 | A | * | 8/1967 | Bartels | 222/95 |
| 3,592,244 | A | | 7/1971 | Chamberlin | 141/14 |
| 3,601,164 | A | | 8/1971 | Bruce | 141/20 |
| 3,632,045 | A | | 1/1972 | Oana | 239/307 |
| 3,709,410 | A | * | 1/1973 | Cunningham | 222/402.16 |
| 4,093,123 | A | | 6/1978 | Maran | 239/322 |
| 4,167,743 | A | | 9/1979 | Corwin | 346/140 |
| 4,197,884 | A | | 4/1980 | Maran | 141/383 |
| 4,367,737 | A | | 1/1983 | Kozam et al. | 128/215 |
| 4,427,039 | A | | 1/1984 | Brooks et al. | 141/20 |
| 4,474,307 | A | | 10/1984 | Chappell | 222/1 |
| 4,658,979 | A | * | 4/1987 | Mietz et al. | 220/203.13 |
| 4,988,017 | A | | 1/1991 | Schrader et al. | 222/130 |
| 5,092,750 | A | | 3/1992 | Leroy et al. | 417/571 |
| 5,343,904 | A | | 9/1994 | Kaeser | 141/20 |
| 5,462,099 | A | | 10/1995 | Demarest et al. | 141/3 |
| 5,524,680 | A | | 6/1996 | De Laforcade | 141/18 |
| 5,623,974 | A | | 4/1997 | Losenno et al. | 141/20 |
| 5,641,004 | A | | 6/1997 | Py | 141/3 |
| 6,099,504 | A | | 8/2000 | Gross et al. | 604/140 |
| 6,435,231 | B1 | | 8/2002 | Cooper et al. | 141/346 |
| 6,607,012 | B2 | | 8/2003 | Yquel | 141/20 |
| 6,637,470 | B2 | | 10/2003 | Reihl et al. | 141/27 |
| 6,729,362 | B2 | * | 5/2004 | Scheindel | 141/20 |

* cited by examiner

*Primary Examiner*—Timothy L. Maust
(74) *Attorney, Agent, or Firm*—Gordon & Jacobson, PC

(57) ABSTRACT

A refillable container includes a filling valve, and a pressurization station having housing at which a needle is coupled to a compressor. The needle includes an enlarged frustoconical head, a reduced diameter neck, and a larger diameter base. The filling valve has an upper split portion, a frustoconical section expanding downward and terminating in a barb, and a lower flared flange, and defines an interior space having a first portion sized to accommodate the head of the needle, a reduced diameter neck portion, and a flared third portion providing an entrance for the needle. Upon compressor actuation, air is forced into the valve and causes the bills of the valve to flutter open to pressurize the container. As pressure within the container increases, force against the valve from within the container increases, locking the container on the needle. The container may be guided onto the needle with minimal effort.

31 Claims, 8 Drawing Sheets

PRESSURIZING SYSTEM FOR A DISPENSING CONTAINER

BACKGROUND OF THE INVENTION

1. Field of the Invention

This invention relates broadly to systems for pressurizing pressurized dispensers. More particularly, this invention relates to filling valves for the dispensers and cooperating elements on the dispenser and a pressurizing station.

2. State of the Art

Pressurized aerosol containers are popular to dispense cooking oils, grooming products such as hairspray and deodorant, insect repellants, etc. In most cases, regardless of what the containers dispense, they are pressurized at the point of filling by the addition of some sort of propellant gas. The containers are single-use items that are not reusable or even easily recyclable.

One approach to solving these problems is that provided by the popular MISTO® aerosol sprayers marketed by the assignee of the present invention. This container is an operationally pressurizable container having a built in pressure valve that can be refilled. Air is pumped into the unit by a pump which is an integral part of the container. While such a unit has many virtues, it does require the user to expend time and energy repressurizing the container, a fact that becomes significant in situations of either heavy use of the dispensing unit or for end users for who either the time factor or the required physical effort are concerns.

U.S. Pat. Nos. 5,623,974 to Losenno et al., 5,462,099 to Demarest et al., and 5,343,904 to Kaeser disclose refillable aerosol containers which are couplable to a separate compressor for pressurization. In Kaeser, a complex locking mechanism is provided to lock the container to the compressor during refill to prevent the container from blowing off a refill needle during pressurization. In Losenno et al. and Demarest et al. no such locking mechanism is provided, and the user must apply manual force to the container during pressurization to prevent the container from blowing off the pressurization needle. These designs, for whatever reason, have failed to either reach the commercial market or be commercially successful. It is believed that it is essential that any such refillable pressurizable container system be extremely easy to use and be capable of being refilled without user force during pressurization.

SUMMARY OF THE INVENTION

It is therefore an object of the invention to provide an aerosol container and a pressurization system therefor which are very easy to use.

It is another object of the invention to provide an aerosol container and a pressurization system therefor which does not require user force during pressurization.

It is also an object of the invention to provide an aerosol container and a pressurization system therefor in which the container is automatically held relative to the pressurization system during pressurization.

It is a further object of the invention to provide structural configurations for an aerosol container and a pressurization system so that the container is forced into an orientation in which a pressurization valve in the container is perfectly mated with a pressurization needle on the compressor component for pressurization.

In accord with these objects, which will be discussed in detail below, a refillable aerosol container and a pressurization station therefor are provided. The container generally includes a fluid tight compartment defined by a bottle and a screw cap, a filling valve at a lower end of the bottle, and a spray nozzle coupled to the cap. The pressurization station includes a housing including a compressor and a power switch. The housing further defines a collar defining a recess in which a hollow pressurization needle is provided. The needle is in fluid communication with the output of the compressor.

In accord with a first aspect of the invention, the needle is provided with an enlarged generally frustoconical head portion, a reduced diameter neck portion, and a relative larger diameter base portion. The filling valve of the container is a resilient duck-bill type valve. The valve includes an upper split portion defining two relatively flat "bills" that meet, a generally frustoconical section expanding downward and terminating in a barb, and a lower flared flange. The valve engages the lower end of the bottle between the barb (which also facilitates valve insertion) and the flared flange. The valve includes an interior space having a first portion sized to accommodate the head of the needle, a reduced diameter neck portion, and a flared third portion providing an entrance for the needle. The container may be seated over the needle with relatively little user force. When the container is fully seated on the needle and no pressurizing force is present, the head of the needle resides within the first portion of the interior space and the neck of the needle resides in the narrower neck portion, and the split valve remains closed. This prevents any of the contents of the bottle from escaping. When the compressor is operated, pressurizing fluid, e.g., air, is forced into the valve and causes the bills of the valve to flutter open to pressurize the container. Furthermore, as the pressure within the container increases, the force against the valve from the container contents increases. As such, the force of the contents against the frustoconical portion decreases the diameter of the neck portion of the interior space, thereby capturing the head portion of the needle within the valve and preventing the container from blowing off the needle, even at maximum fill pressure, e.g., 70 to 100 psi.

In accord with a second aspect of the invention, the collar of the housing is sized and contoured to guide the lower end of the container such that the needle enters the fill valve in straight vertical alignment. This permits very easy alignment between the needle and valve without user concern for a misalignment, which could otherwise cause valve puncture or wasted user time.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
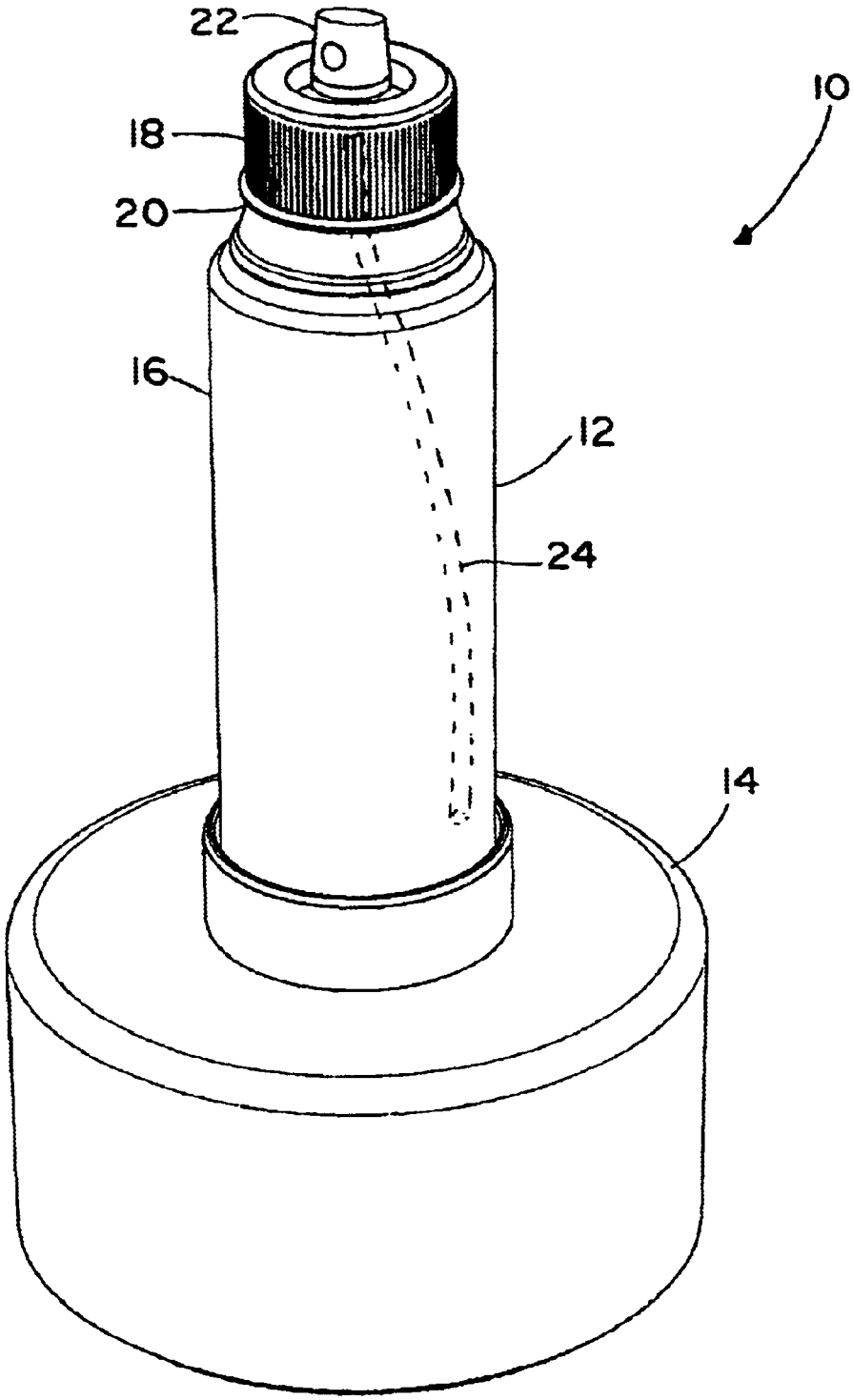
FIG. 1 is a perspective view of a refillable aerosol container docked to a pressurizing system therefor.
Figure 2:
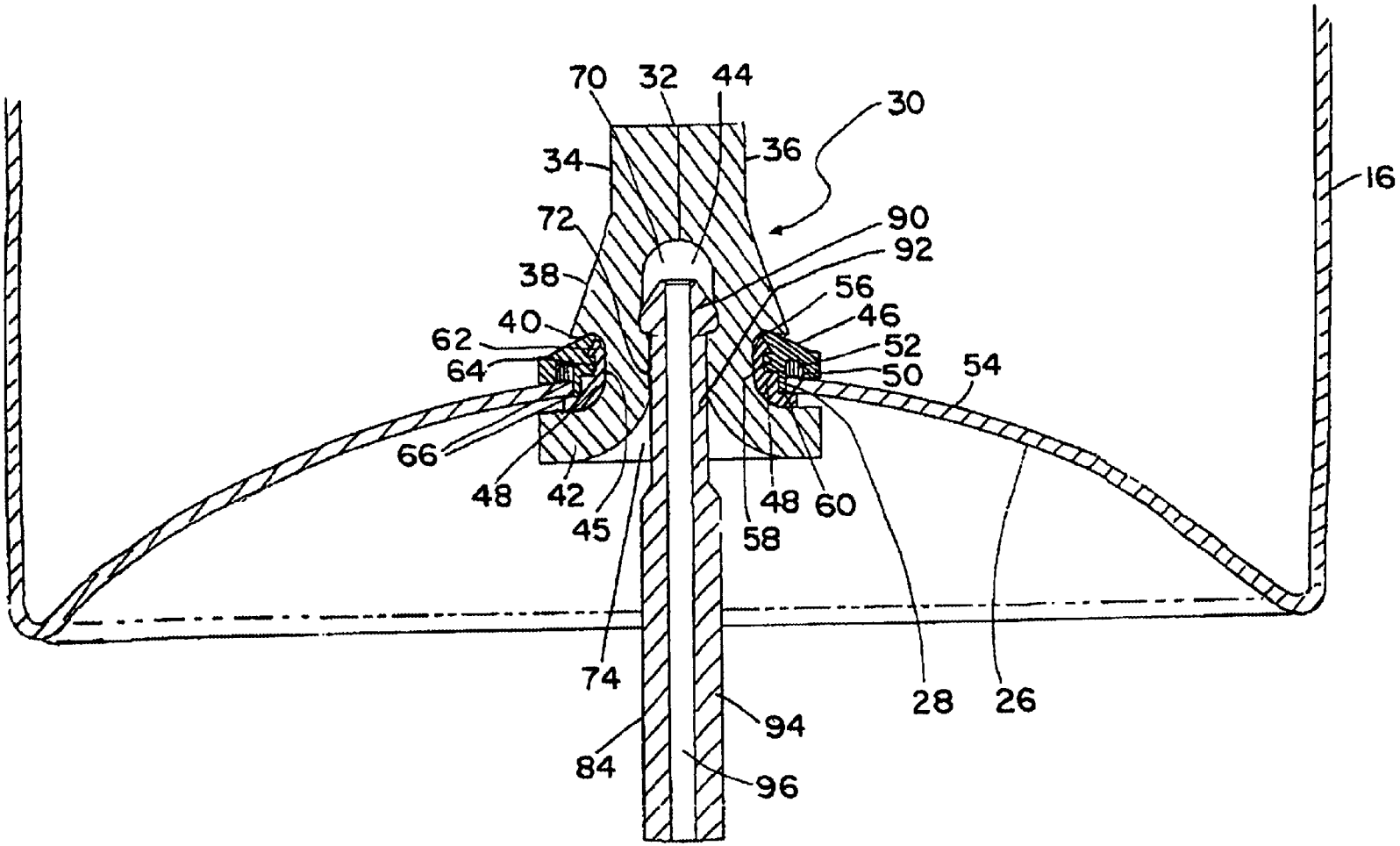
FIG. 2 is a longitudinal section of a lower end of the container coupled over a needle of the pressurizing system, wherein the container is provided with a first embodiment of a valve.

Turning now to FIGS. 1 and 2, a system 10 comprising a refillable aerosol container 12 and a pressurization station 14 therefor are shown. The container 12 generally includes a fluid tight compartment defined by a bottle 16 and a screw cap 18 threadably engaged over an open end 20 of the bottle. The cap 18 is provided with an aerosol spray nozzle 22 which is coupled to a tube 24 which extends from the nozzle into a lower portion of the bottle 16. The bottom 26 of the bottle 16 is preferably concave at its exterior surface (and convex at its interior), and a circular hole 28 is provided at: the center of the bottom.

Referring to FIG. 2, a filling valve 30, generally of the duck-bill variety, is provided in the hole 28. The valve 30 includes an upper split portion 32 defining two relatively flat "bills" 34, 36 that meet to provide a seal, a generally frustoconical section 38 expanding downward and terminating in a barb 40, a lower annular flared flange 42, and an interior space 44. An annular groove 45 is defined between the barb 40 and the flange 42.

According to a first embodiment of the invention, the valve 30 is stabilized within the hole 28 with an annular catch 46 which resides at the circumference of the hole 28 and a resilient annular strain relief member 48 which engages the inner portion of the catch 46. More particularly, the catch 46 includes ring groove 50, a barb projection 56, inner rim 58, and a side wall 60. When the catch 46 is positioned at the hole 28 from inside the bottle 16, the side wall 60 fits against the circumference of the hole 28 to position the catch 46 concentrically with the hole 28. The ring groove 50 holds an o-ring 52 against the interior surface 54 of the bottom 26 of the bottle 16 to provide a fluid tight seal thereat. The strain relief member 48 includes an upper barb 62 and a groove 64. When the strain relief member is pushed through the catch 46 from the bottom 26 of the bottle 16 (i.e., from outside the bottle), the barb 62 seats over the inner rim 58 of the catch 46, and the inner rim 58 is engaged within the groove 64. The valve 30 is then pushed through the lower end of the strain relief member 48 such that the frustoconical portion 38 resides within the bottle and the barb 40 passes through and seats above the projections 56 of the catch member 46. The catch member 46 and strain relief member 48 are positioned within and about the annular groove 45 in the valve 30 (with the barb 40 of the valve seating above members 46 and 48, and the flared flange 42 of the valve seating below members 46 and 48). This locks the valve 30 relative to the bottom of the bottle 16 and provides a fluid tight seal about the valve's periphery. Importantly, where the hole 28 in the bottle 16 is a punched hole with potentially sharp edges 66, the catch 46 and strain relief 48 operate to shield such sharp edges from contact with the resilient valve 30, thereby preventing damage to the valve that may otherwise occur.

Figure 3:
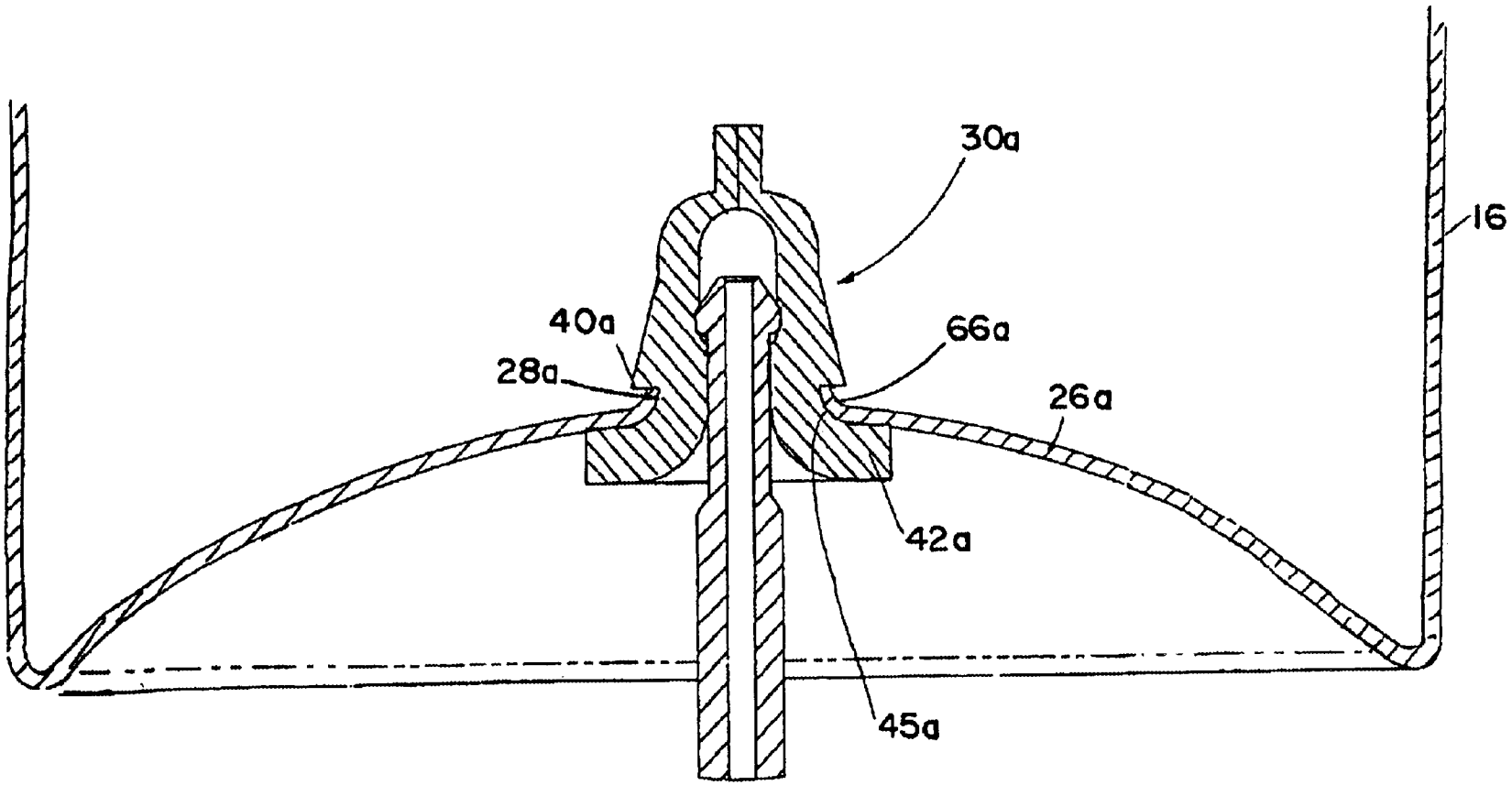
FIG. 3 is a longitudinal section of a lower end of the container coupled over the needle of the pressurizing system, wherein the container is provided with a second embodiment of the valve shown rotated 90° relative to the valve in FIG. 2.

Turning now to FIG. 3, a second embodiment of the coupling between a valve 30*a* and the bottle 16 is shown. In the second embodiment, the edge 66*a* about the hole 28*a* in the bottom 26*a* of the bottle 16 may be bent inward (i.e., upturned) to provide a rounded contour. In such an embodiment, the rounded contour is unlikely to cause damage to the valve 30*a*. Thus, the catch 46 and strain relief 48 (FIG. 2) are not as advantageous and may be eliminated. If eliminated, the annular groove 45*a* about the valve 30*a* is preferably reduced in width (the dimension between the barb 40*a* and the flange 42*a*) to correspond to the upturned portion of the bottom 26*a*, while the other aspects of the valve preferably substantially remain the same. The valve 30*a* is then pushed through the hole 28*a* such that the barb 40*a* of the valve 30*a* resiliently deforms, passes through the hole, and then expands to capture the upturned edge 66*a* within the annular groove 45*a*, between the barb 66*a* and the flange 42*a*.

Turning back to FIG. 2, regardless of the manner in which the valve 30 is coupled within the bottom of the bottle, the interior space 44 of the valve 30 includes a relatively large first portion 70, a reduced diameter neck portion 72, and a flared third portion 74.

Figure 4:
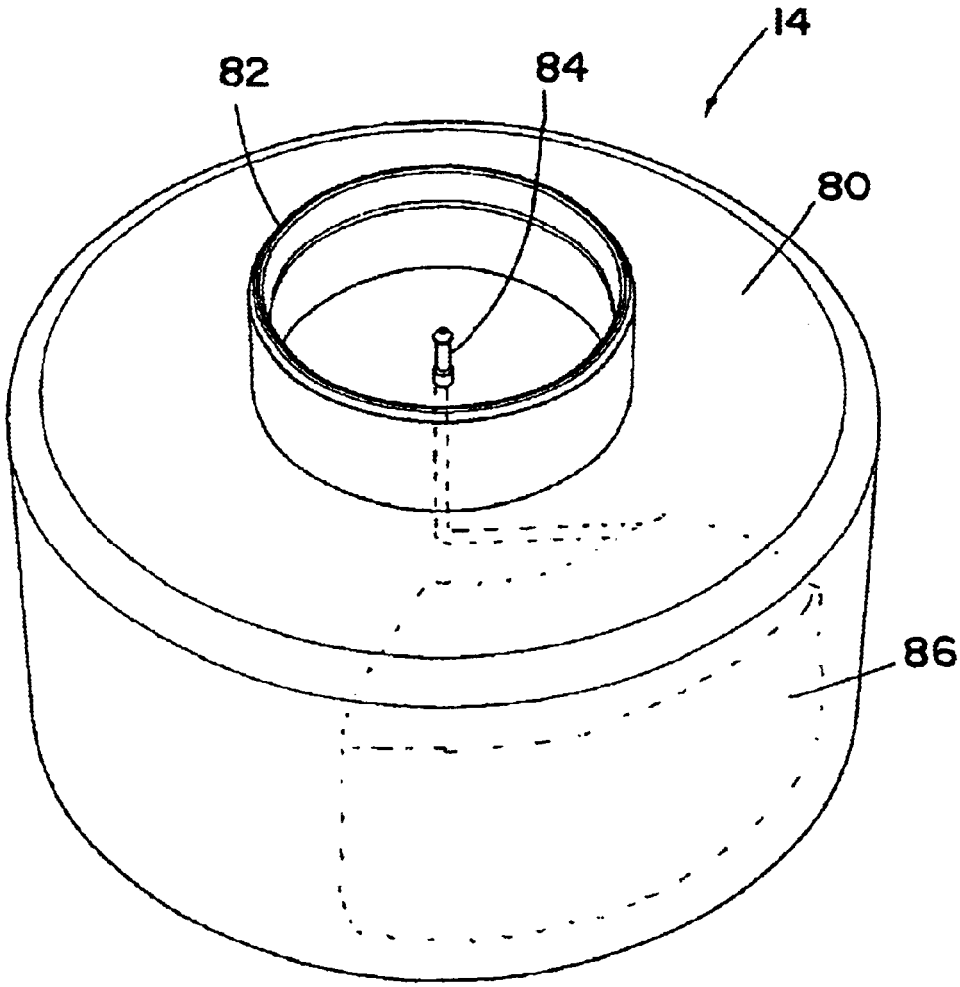
FIG. 4 is a perspective view of the pressurizing system.

Referring now to FIG. 4, the pressurization station 14 includes a housing 80 having an external dock 82 for receiving the lower end of the bottle 16 and a hollow needle 84 at the center of the dock. The needle 84 is coupled to a compressor 86 within the housing 80. The housing 80 also includes appropriate switches to activate the compressor, a power supply, and other essential components, not shown, but which are well known in the art. For example, U.S. Pat. Nos. 5,623,974 to Losenno et al., 5,462,099 to Demarest et al., and 5,343,904 to Kaeser disclose the essential elements within a docking station and are hereby incorporated by reference herein in their entireties.

Referring to FIGS. 2 and 4, the needle 84 includes an enlarged generally frustoconically tapering head portion 90, a reduced diameter neck portion 92, and a relative larger diameter base portion 94. An axial throughbore 96 is defined therethrough. The interior space 44 of the valve 30 accommodates the head 90 and neck portion 92 of the needle 84, with the head 90 fitting diametrically snugly within the first portion 70 of the space 44, and the neck portion 92 of the needle 84 fitting diametrically snugly within the neck portion 72 of the space and extending within the flared third portion 74 of the space 44. The bills 34, 36 are located higher than the head 90 of the needle 84, such that even when the needle is fully inserted into the valve 30, the valve remains closed.

Figure 5:
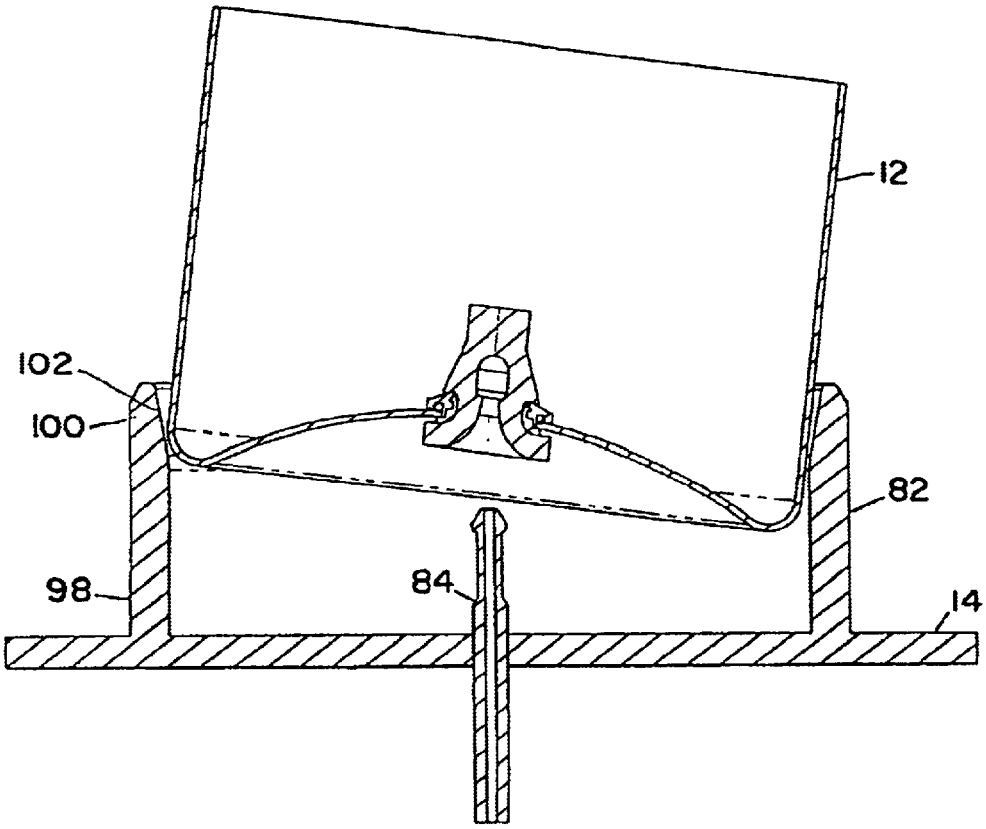
FIGS. 5 through 7 are longitudinal section views illustrating docking the container to the pressurization system.
Figure 6:
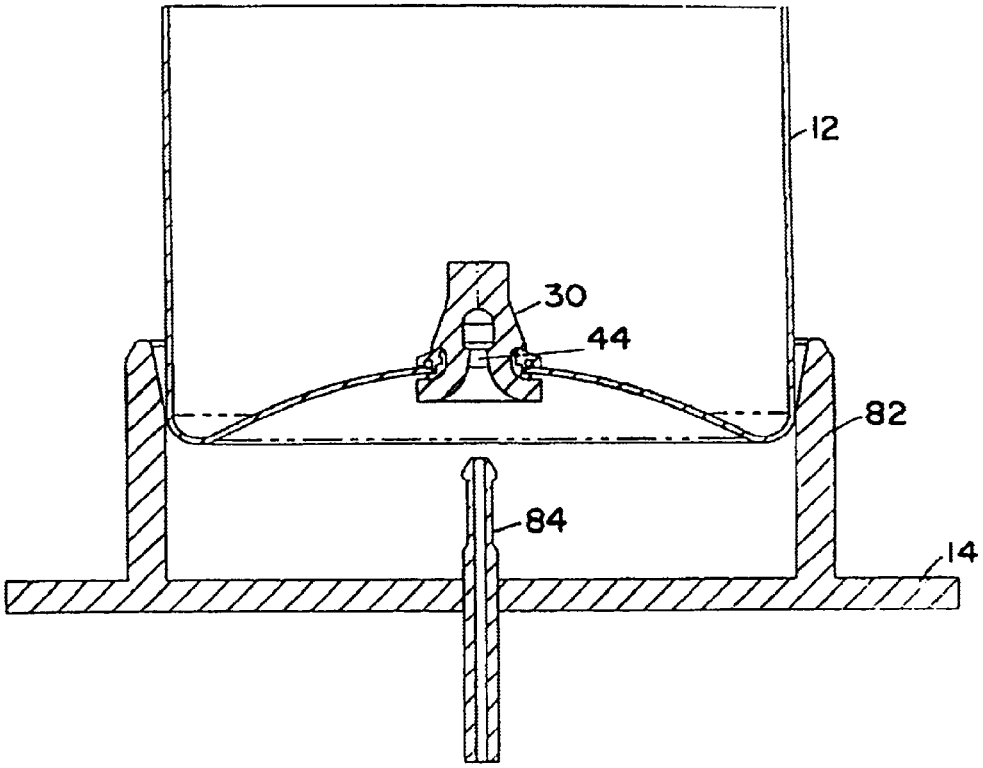

Referring to FIGS. 1, 5 and 6, the dock 82 of the housing 14 is generally a collar sized and contoured to guide the container 12 into an orientation in which the valve is aligned with the pressurization needle 84 on the pressurization station 14 (FIG. 6). The dock 82 has a cylindrically tubular lower portion 98 (approximately 0.53 inch in height) having an inner diameter (e.g., 1.980 inches) which is just slightly larger (e.g., 0.010 inch clearance) than the outer diameter at the lower end of the container 12 (e.g., 1.970 inches), and an upper portion 100 with a surface 102 beveled outward relative to the inner surface of the lower portion 98. The upper portion 100 bevels out to an inner diameter of, e.g., 2.060 inches; i.e., preferably approximately 0.090 inch greater than the lower end of the container. The dock 82 has a total height of preferably approximately 0.780 inch, with the lower portion. 98 having a height of preferably approximately 0.53 inch, and the upper portion 100 having a height of preferably approximately 0.23 inch. When a container 12 is positioned at the dock, even at an angle, the beveled surface 102 guides the lower end of the container 12 into lower portion 98. Referring to FIG. 6, in this manner, the interior space 44 of the valve 30 is automatically aligned relative to the needle 84 without user concern for a misalignment, which could otherwise cause valve puncture or wasted user time with respect to alignment.

Figure 7:
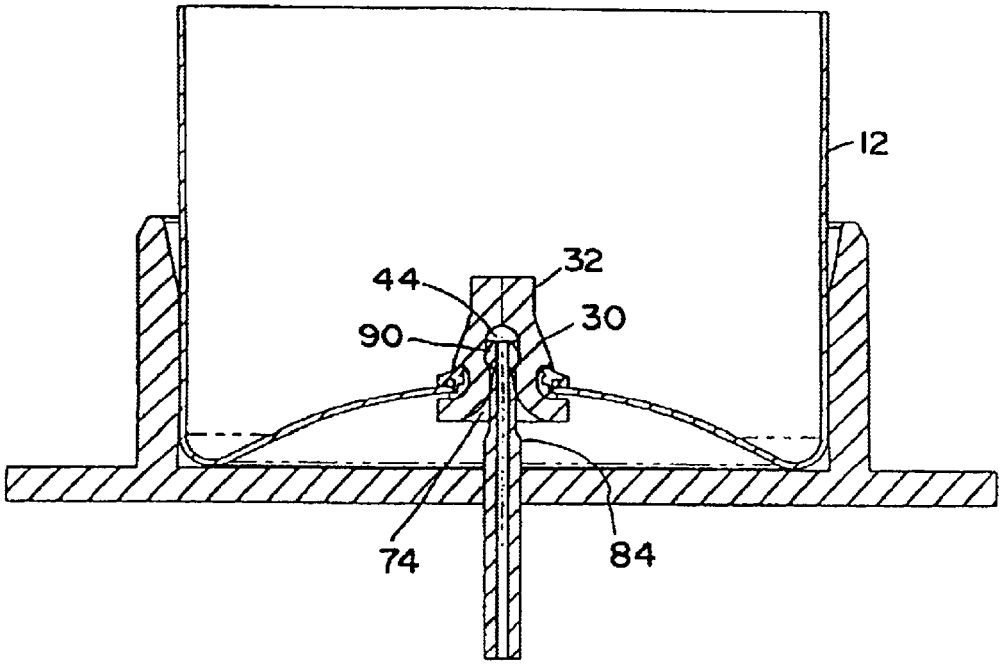

In use, during a first filling, the cap 18 is removed from the bottle 16 and a selected liquid is poured through the open end 20 of the bottle. The cap 18 is then threaded back onto the bottle 16 until the bottle is closed. The container 12 is then inserted into the dock 82 such that the needle 84 is inserted into the valve 30 (FIG. 7). The tapered end of the head 90 of the needle 84 and flared opening 74 of the valve 30 facilitate the coupling between the needle and valve such that the container and valve may be coupled with relatively little user force.

Referring to FIGS. 2 and 7, when the container 12 is fully seated in the dock 82 and fully seated on the needle 84 and no pressurizing force is present, the head 92 of the needle 84 resides within the first portion 70 of the interior space 44 and the neck 92 of the needle resides in the narrower neck portion 72 of the space, and the split valve 32 remains closed. This prevents any of the fluid contents of the container 12 from escaping.

Figure 8:
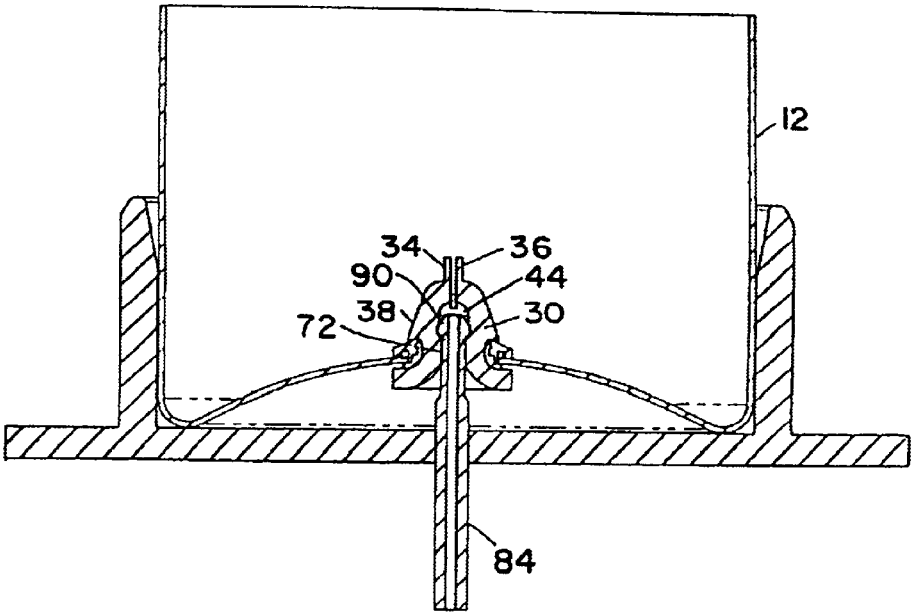
FIG. 8 is a longitudinal section view similar to FIG. 7 but oriented 90° relative to the view of FIG. 7, showing the valve in an open position when receiving a pressurizing fluid from the needle.

Referring to FIGS. 1 and 8, when the compressor 86 of the pressurization system 14 is operated, e.g., by actuation of a switch (not shown), gas, e.g., air, under pressure is forced through the needle 84 and into the valve 30. This causes the bills 34, 36 of the valve 30 to flutter open such that the gas pressurizes the container 12. Furthermore, as the pressure within the container 12 increases, the force against the valve 30 from the container contents increases. As such, the force of the contents against the frustoconical portion 38 of the valve 30 decreases the diameter of the neck portion 72 of the interior space 44. This captures the head portion 90 of the needle 84 within the valve 30 and prevents the container 12 from blowing off the needle 84, even at maximum fill pressure, e.g., 70 to 100 psi. Preferably, the pressurization station 14 includes means for automatically deactivating the compressor 82 when a desired fill pressure is reached. As soon as the compressor 86 is turned off, the bills 34, 36 of the valve 30 close; preventing any backflow of the contents through valve.

The container 12 is then removed from the pressurization station 14. The spray nozzle 22 may then be depressed to release an aerosolized form of the fluid contents of the container 12. When the container 12 is depressurized (either partly or completely), i.e., after significant use or after removal and replacement of the cap 18 from the bottle 16, the container may be positioned within the dock 82 of the pressurization station 14, and re-pressurized as described above.

There have been described and illustrated herein embodiments of a system including a refillable aerosol container and a pressurization station. While particular embodiments of the invention have been described, it is not intended that the invention be limited thereto, as it is intended that the invention be as broad in scope as the art will allow and that the specification be read likewise. Thus, while particular preferred dimensions for an embodiment of the system have been disclosed, it is recognized that other embodiments of greatly differing dimensions may be provided. In addition, while the dispensing container is disclosed as being a bottle, the pressurizing station and valve may be used with other dispensing containers, such as tubes, boxes, etc. Also, while the preferred container is disclosed as dispensing an aerosol, it is appreciated that the pressurizing station may pressurize a container which is adapted to dispense any material dispensable under pressure. Such dispensable materials include, but are not limited to, fluids, gels, pastes, and powders. It will therefore be appreciated by those skilled in the art that yet other modifications could be made to the provided invention without deviating from its spirit and scope as claimed.

What is claimed is:

1. A refillable and refillable container for containing and dispensing a dispensable material, comprising:

a) a container having an opening;

b) a fill valve coupled in said container, said fill valve including an upper split portion defining two resilient relatively flat bills that are in contact to completely seal said fill valve in a natural state, a section expanding away from said bills and terminating in a barb, a lower annular flared flange extending outside said container, and an annular groove is defined between said barb and said flange, said fill valve having an interior space;

c) a cap removably coupled to said opening to retain the dispensing material in said container except when an outlet valve is actuated; and d) an actuatable outlet valve coupled to said cap, wherein, when said container contains the dispensable material and is pressurized, actuation of said outlet valve releases a dispensed form of the dispensable material from said outlet valve.

2. A container according to claim 1, wherein:

said interior space has a first portion, a reduced diameter middle neck portion, and a flared third portion which provides an opening into said interior space.

3. A refillable and repressurizable container for containing and dispensing a dispensable material, comprising:

a) a container having an opening and a surface having a hole, and an edge about said hole is bent inward toward an interior of said container to provide a rounded contour;

b) a fill valve coupled in said container, said fill valve including an upper split portion defining two resilient relatively flat bills that are in contact, a section expanding away from said bills and terminating in a barb, a lower annular flared flange, and an annular groove is defined between said barb and said flange, wherein said edge of said container lies within said annular groove of said fill valve, between said barb and said flange, said fill valve having an interior space;

c) a cap removably coupled to said opening; and d) an actuatable outlet valve coupled to said cap, wherein when said container contains the dispensable material and is pressurized, actuation of said outlet valve releases a dispensed from of the dispensable material from said outlet valve.

4. A container according to claim 1, further comprising:

e) at least one separating element, wherein said container includes a surface defining a hole having an edge thereabout, and said fill valve extends through said hole and said at least one separating element separates said fill valve from said edge.

5. A refillable and repressurizable container for containing and dispensing a dispensable material, comprising:

a) a container having an opening;

b) a fill valve coupled in said container, said fill valve including an upper split portion defining two resilient relatively flat bills that are in contact, a section expanding away from said bills and terminating in a barb, a lower annular flared flange, and an annular groove is defined between said barb and said flange, said fill valve having an interior space;

c) a cap removably coupled to said opening;

d) an actuatable outlet valve coupled to said cap, wherein when said container contains the dispensable material and is pressurized, actuation of said outlet valve releases a dispensed from of the dispensable material from said outlet valve; and e) at least one separating element, wherein said container includes a surface defining a hole having an edge thereabout, and said fill valve extends through said hole and said at least one separating element separates said fill valve from said edge and said barb of said fill valve lies above a first portion of said at least one separating element, and said flange of said fill valve lies below a second portion of said at least one separating element.

6. A container according to claim 4, wherein:

said at least one separating element includes a material which is softer than said edge of said container.

7. A container according to claim 4, wherein:

said at least one separating element includes an interior surface which is less angular than said edge about said hole in said, surface of said container.

8. A refillable and repressurizable container for containing and dispensing a dispensable material, comprising:

a) a container having an opening;

b) a fill valve coupled in said container, said fill valve including an upper split portion defining two resilient relatively flat bills that are in contact, a section expanding away from said bills and terminating in a barb, a lower annular flared flange, an annular groove is defined between said barb and said flange, said fill valve having an interior space;

c) a cap removably coupled to said opening;

d) an actuatable outlet valve coupled to said cap, wherein when said container contains the dispensable material and is pressurized, actuation of said outlet valve releases a dispensed form of the dispensable material from said outlet valve;

e) an annular catch; and f) a resilient strain relief member, wherein said container includes a surface defining a hole having an edge thereabout, and said annular catch is positioned between said fill valve and said edge and said strain relief member is positioned between said fill valve and said catch, with said strain relief member being in contact with said annular catch.

9. A container according to claim 8, further comprising:

g) an o-ring forming a fluid tight seal between the catch and said surface of said container.

10. A container according to claim 8, wherein:

said strain relief member is locked relative to said annular catch.

11. A container according to claim 8, wherein:

said strain relief member defines an inner smooth surface which lies within said annular groove of said fill valve.

12. A container according to claim 1, wherein:

said section of said fill valve expanding away from said bills is frustoconical in shape.

13. A container according to claim 1, wherein:

said container is adapted to contain a liquid and said outlet valve is spray valve adapted to dispense the liquid in an aerosolized form.

14. A refillable and repressurizable container for containing and dispensing a dispensable material, comprising:

a) a container having an open end and surface provided with a hole spaced apart from said open end and having an edge thereabout;

b) a resilient fill valve extending through said hole, said fill valve defining an interior space, said fill valve naturally in a completely closed configuration and being movable to an open configuration upon application of a pressurizing gas into said interior space;

c) at least one separating element separating said fill valve from physical contact with said edge;

d) a cap removably coupled to said open end; and e) an actuatable outlet valve coupled to said cap, wherein when said container contains the dispensable material and is pressurized, actuation of said outlet valve releases a dispensed form of the material from said outlet valve.

15. A container according to claim 14, wherein:

said fill valve includes a barb and a flange and defines an annular groove between said barb and said flange, wherein said barb lies above a first portion of said at least one separating element, and said flange of said fill valve lies below a second portion of said at least one separating element.

16. A container according to claim 14, wherein:

said at least one separating element includes a material which is softer than said edge of said container.

17. A container according to claim 14, wherein:

said at least one separating element includes an interior surface which is less angular than said edge about said hole in said container.

18. A container according to claim 14, wherein:

said container is adapted to contain a liquid and said outlet valve is spray valve adapted to dispense the liquid in an aerosolized form.

19. A pressurizing system for a pressurizable container, comprising:

a) a pressurization station including a compressor and a needle in communication with said compressor, said needle having a head portion and a relatively reduced diameter neck portion; and b) a refillable and repressurizable container for containing a dispensing material and dispensing said dispensing material is a dispensed form, said container including a resilient fill valve defining an interior space having a head portion, a reduced diameter neck portion, and a flared opening portion, said fill valve being naturally in a closed configuration and being moved to an open configuration upon application of a pressurizing gas into said interior space, wherein when said container is seated over said needle, said needle extends within said valve such that said head portion of said needle resides within said held portion of said fill valve, said neck portion of said needle resides within said neck portion of said fill valve, wherein upon actuation of said compressor, a pressurizing gas is forced through said needle, opens said fill valve, and pressurizes said container, said pressurization of said container causing said valve to grip said needle to retain said container on said needle.

20. A system according to claim 19, wherein:

said needle further includes a base portion which is relatively larger in diameter than said neck portion.

21. A system according to claim 19, wherein:

said head portion has a tapered end.

22. A system according to claim 19, wherein:

said head portion has a frustoconical tip.

23. A system according to claim 19, wherein:

said station includes an upstanding collar surrounding said needle.

24. A system according to claim 19, wherein:

said dispensable material is a fluid, and said dispensed form is an aerosol.

25. A pressurizing system for a pressurizable container, comprising:

a) a pressurization station including a compressor, a needle in communication with said compressor, and an upstanding collar surrounding said needle, said collar having a cylindrically tubular lower portion having a first inner diameter, and an upper portion with a surface beveled outward relative to said inner surface of said lower portion of said collar; and b) a refillable and repressurizable container for containing a dispensable material and dispensing said material in a dispensed form, said container including a lower end having an outer diameter and provided with a fill valve adapted to be engaged by said needle, wherein when said container is positioned at said collar, said beveled inner surface guides said lower end of said container into said lower portion of said collar and into alignment with said needle.

26. A pressurizing system according to claim 25, wherein:

a clearance between said lower end of said container and said collar is approximately nine times greater at said upper portion than at said lower portion.

27. A pressurizing system according to claim 25, wherein:

said first diameter is 0.010 inch greater than said outer diameter of said lower end of said container.

28. A pressurizing system according to claim 25, wherein:

said upper portion of said collar has a maximum inner diameter which is 0.090 inch greater than said outer diameter of said lower end of said container.

29. A pressurizing system according to claim 25, wherein:

said dispensable material is a fluid, and said dispensed form is an aerosol.

30. A pressurizing system for a container adapted to store and dispense a dispensable material, comprising:

a) a pressurization station including a compressor, a needle in communication with said compressor; and b) a refillable and repressurizable contain for containing the dispensable material and dispensing the material in a dispensed form, said container including a surface provided with a fill valve adapted to be engaged by said needle, said fill valve defining an interior space and two resilient separable bill portions which extend above said interior space and which are naturally in contact to closed said fill valve, wherein when said container is fully seated on said needle but said needle is not providing a pressurizing fluid from said compressor into said fill valve, said needle extends within said interior space but does not extend between said bill portions and said fill valve is closed, and wherein when said needle provides a pressurizing fluid into said fill valve, said bill portions of said fill valve separate to open said fill valve.

31. A system according to claim 30, wherein:

said dispensable material is a fluid, and said dispensed form is an aerosol.

* * * * *